United States Patent [19]

Sato et al.

[11] 4,223,419

[45] Sep. 23, 1980

[54] SHOULDER-SUPPORTED PNEUMATIC SWEEPING APPARATUS

[75] Inventors: Masatoshi Sato, Tokyo; Hidenori Kajiyoshi, Koganei, both of Japan

[73] Assignee: Kioritz Corporation, Tokyo, Japan

[21] Appl. No.: 73,585

[22] Filed: Sep. 7, 1979

Related U.S. Application Data

[63] Continuation-in-part of Ser. No. 897,328, Apr. 18, 1978, abandoned.

[30] Foreign Application Priority Data

Feb. 15, 1978 [JP] Japan ..... 53-18261[U]

[51] Int. Cl.[3] ..... A47L 5/14

[52] U.S. Cl. ..... 15/327 C; 15/405; 15/410

[58] Field of Search ..... 15/327 C, 405, 406, 15/410; 30/381

[56] References Cited

U.S. PATENT DOCUMENTS

| | | | |
|---|---|---|---|
| 1,661,480 | 3/1928 | Keefer | 15/410 X |
| 1,666,350 | 4/1928 | Pitt | 15/405 X |
| 2,056,850 | 10/1936 | Goughnor | 15/410 X |
| 2,568,039 | 9/1951 | Torrell | 15/405 X |
| 2,586,145 | 9/1952 | Brever et al. | 15/327 C X |
| 3,889,763 | 6/1975 | Dillon | 30/381 X |
| 4,070,771 | 1/1978 | Yakiwchuk | 15/405 X |

FOREIGN PATENT DOCUMENTS

| | | | |
|---|---|---|---|
| 2256875 | 5/1973 | Fed. Rep. of Germany | 15/405 |

OTHER PUBLICATIONS

Washington Star, Sep. 23, 1977, "Look, Up in the Sky."

*Primary Examiner*—Christopher K. Moore
*Attorney, Agent, or Firm*—Karl W. Flocks

[57] ABSTRACT

A shoulder-supported pneumatic sweeping apparatus including a frame having attached to its upper portion a grip having a shoulder strap connected thereto, and formed at one end thereof with an air outlet port connected through a flexible pipe to an air ejecting pipe having an operating handle attached thereto. The frame is supported by the shoulder of the operator through the shoulder strap and prevented from moving unsteadily with one hand while the air ejecting pipe is operated with the other hand.

3 Claims, 2 Drawing Figures

SHOULDER-SUPPORTED PNEUMATIC SWEEPING APPARATUS

This is a continuation-in-part of copending application Ser. No. 897,328, filed Apr. 18, 1978, and now abandoned.

BACKGROUND OF THE INVENTION

This invention relates to sweeping apparatus and more particularly to a pneumatic sweeping apparatus of the type adapted to be easily carried, particularly by means of a strap worn over the shoulder of the operator, for clearing the surface of a vast playground or a baseball field, removing snow from the roads or scattering a pool of water by blowing an air current thereinto.

Portable pneumatic sweeping apparatus which have recently been in use are usually carried on the backs of the operators because they are too heavy to be carried with the hand during a sweeping operation performed over a prolonged period of time. The reason why the pneumatic sweeping apparatus now available are heavy in weight is that they are manufactured by utilizing the engine sections of spraying and dusting apparatus adapted to be carried on the backs. Thus the pneumatic sweeping apparatus now available are not only difficult to handle but injurious to the health of the operators because the vibrations of the apparatus are directly transmitted to the operators' bodies. Also, a difficulty is encountered in immediately removing the apparatus from the backs of the operators in case of accidents involving staining of the apparatus by leaked fuel or the starting of a fire in the apparatus due to engine trouble.

SUMMARY OF THE INVENTION

This invention proposed to solve the aforementioned problems with regard to the use of portable pneumatic sweeping apparatus of the prior art. Accordingly, an object of the invention is to provide a shoulder-supported pneumatic sweeping apparatus which is compact in size and light in weight so that it can readily be carried by means of a strap worn over the shoulder to thereby provide an effective safety measure to cope with the aforementioned accidents. The operator can support the weight of the apparatus by his shoulder and can prevent the apparatus from moving unsteadily with one hand while operating the air ejecting pipe with the other hand during operation.

Another object is to provide a shoulder-supported pneumatic sweeping apparatus which can have its weight supported by the shoulder of the operator and can be held in any position as desired to suit the site and condition of operation by changing the position of the apparatus by holding the grip with one hand while the frame and the air ejecting pipe of the apparatus can be freely manipulated to move to any positions as desired by using both hand. By virtue of this feature, the range of a sweeping operation performed by means of the apparatus can be increased and the apparatus can be easily made to face any direction as desired.

Another object is to provide a shoulder-supported pneumatic sweeping apparatus which is not fixed to the body of the operator during operation, so that the operator is capable of readily freeing himself from the apparatus in the event of an accident and the vibrations of the apparatus will not be directly transmitted to the internal organs of the operator. Thus the apparatus according to the invention provides effective precautions against accidents and for maintaining the operator in good health.

DESCRIPTION OF THE PREFERRED EMBODIMENT

Figure 1:
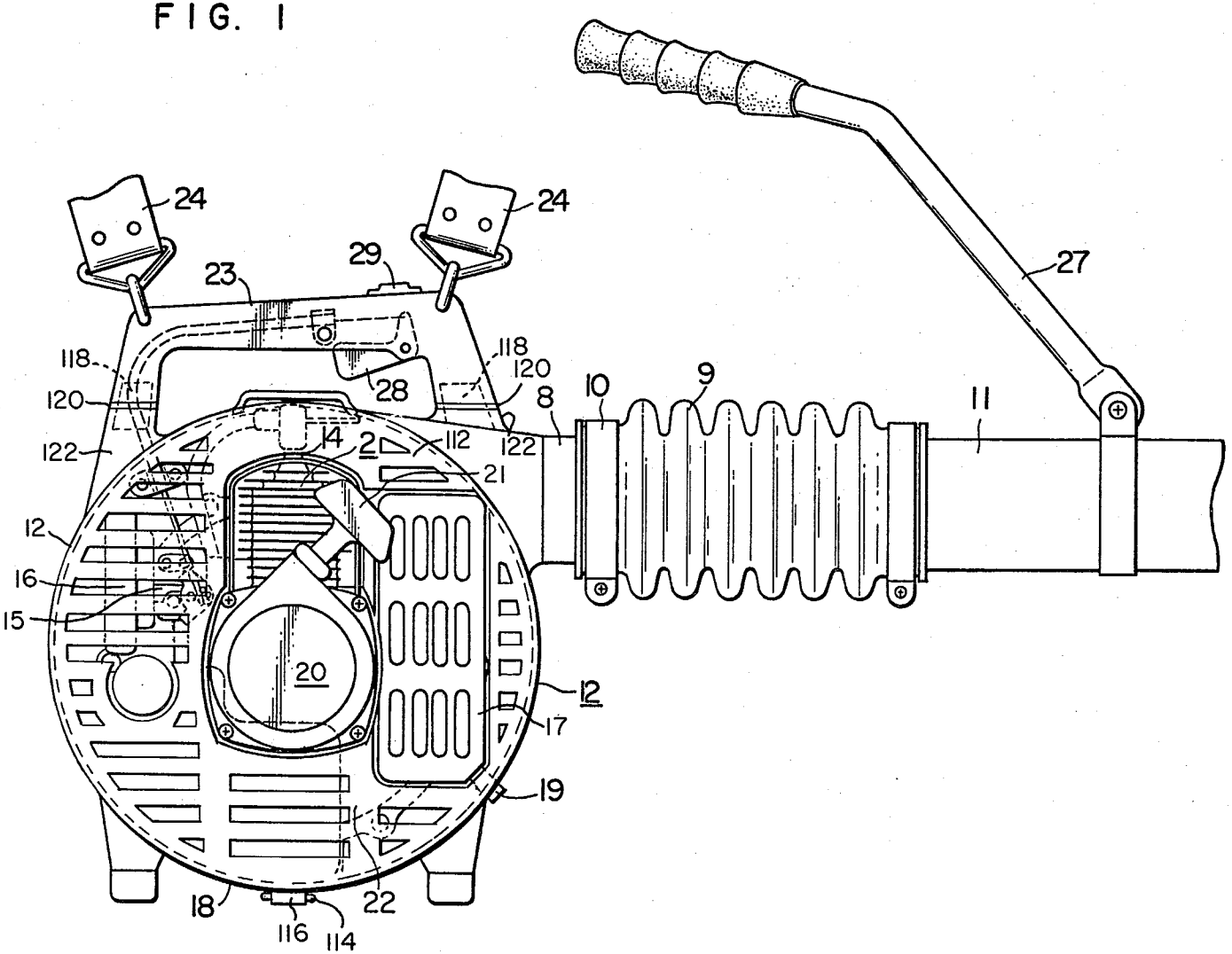
FIG. 1 is a side view of the pneumatic sweeping apparatus having a centrifugal fan which comprises one embodiment of the invention.

The preferred embodiment of the invention will now be described with reference to the accompanying drawings in which a centrifugal fan is mounted on an output shaft of a light weight engine. This arrangement provides the advantage of making it possible to increase the pressure of an air current in a pneumatic sweeping apparatus of the shoulder-supported type. As may be seen in FIGS. 1 and 2, centrifugal fan 1 is directly connected to the output shaft 3 of the light weight engine 2, is housed in a volute casing 7, and upon rotation of the fan 1 an air current is drawn by suction through an inlet port 25 whereby centrifugal forces are imparted thereto. The air current supplied under pressure from the volute casing 7 is led to an outlet port 8 which is cylindrical in shape and inserted in one end of a flexible pipe 9, the cylindrical outlet port 8 and one end of the flexible pipe 9 being secured together by means of a clamping band 10. An air ejection pipe 11 is inserted in the other end of the flexible pipe 9, and the two pipes 9 and 11 are secured to each other by an arrangement similar to the arrangement used for securing the pipe 9 to the outlet port 8.

The outlet port 8 is formed in a frame of the pneumatic sweeping apparatus which is a two-piece member comprising a shell 12 and a detachable cover 112 each of which is cylindrical in shape and encloses therein the volute casing 7 and the light weight engine 2, respectively. As can be seen in the sectional view shown in FIG. 2, the engine section is disposed within cover 112 on the right hand side of the shell 12 and the fan section is within shell 12 on the left hand side of the frame. The engine section includes a cylinder 13, an ignition plug 14, a diaphragm-type carburetor 15, a carburetor cleaner 16, a muffler cover 17 and a fuel tank 18. Thus it can be seen that the elements of the engine section are all housed in the shell 12 and cover 112. An exhaust pipe 19 connected to the muffler extends through the shell 12 outwardly thereof at its lower right portion as seen in FIG. 1. A starter 20 is mounted concentrically with the engine output shaft 3 and has a rope grip 21 connected to its upper end. As can be readily seen in FIG. 2, the fan 1 and the engine section 2 of this embodiment are constructed such that they can be readily assembled with frame which comprises the shell 12 and the cover 112. More specifically, a casing 22 for the engine section and the shell 12 are in engagement with each other in their cylindrical portions and held together by means of screws. Cover 112 is detachably secured to the circular periphery of the shell 12. A rubber strap or belt 113 with fasteners 114 engage with hooks 116 on the shell 12 and cover 112 whereby cover 112 is detachably secured thereon. Upper portions of cover 112 and the shell 12 also engage each other by way of at least one hook element formed on the inside of cover 112, but not illustrated.

Attached to shell 12 at the upper portion thereof by way of rubber vibration insulator members 118 are a grip 23 adapted to be held fast with one hand to carry the frame, and a shoulder strap 24 connected to opposite ends of the upper portion of the grip 23. As may be seen in FIG. 1, spaces 120 between each of the lower ends of grip 23 and mounting ears 122 extending up from shell 12 show grip 23 to be spaced apart from shell 12 and isolated from vibration developed thereat by engine 2 with vibration insulator members 118 providing the connection therebetween. Grip 23 may, within the contemplation of the inventive concept of disclosed apparatus, be detachably secured to mounting ears 122 by means not illustrated. Such securing means, for example, may take the form of nuts and bolts or pins extending downwardly from the generally vertical portions of grip 23 illustrated in FIG. 1, across the spaces 120, and into mounting ears 122 and/or vibration insulator members 118. Additional securing bolts may extend generally horizontally through mounting ears 122 and into vibration insulator members 118. Meanwhile the shell 12 if formed with the inlet port 25 in a portion thereof which is in spaced juxtaposed relation to the fan 1 for sucking an air current therethrough. A protective plate 26 is mounted outside the inlet port 25 so as to prevent the inlet port 25 from being blocked by the body of the operator.

Figure 2:
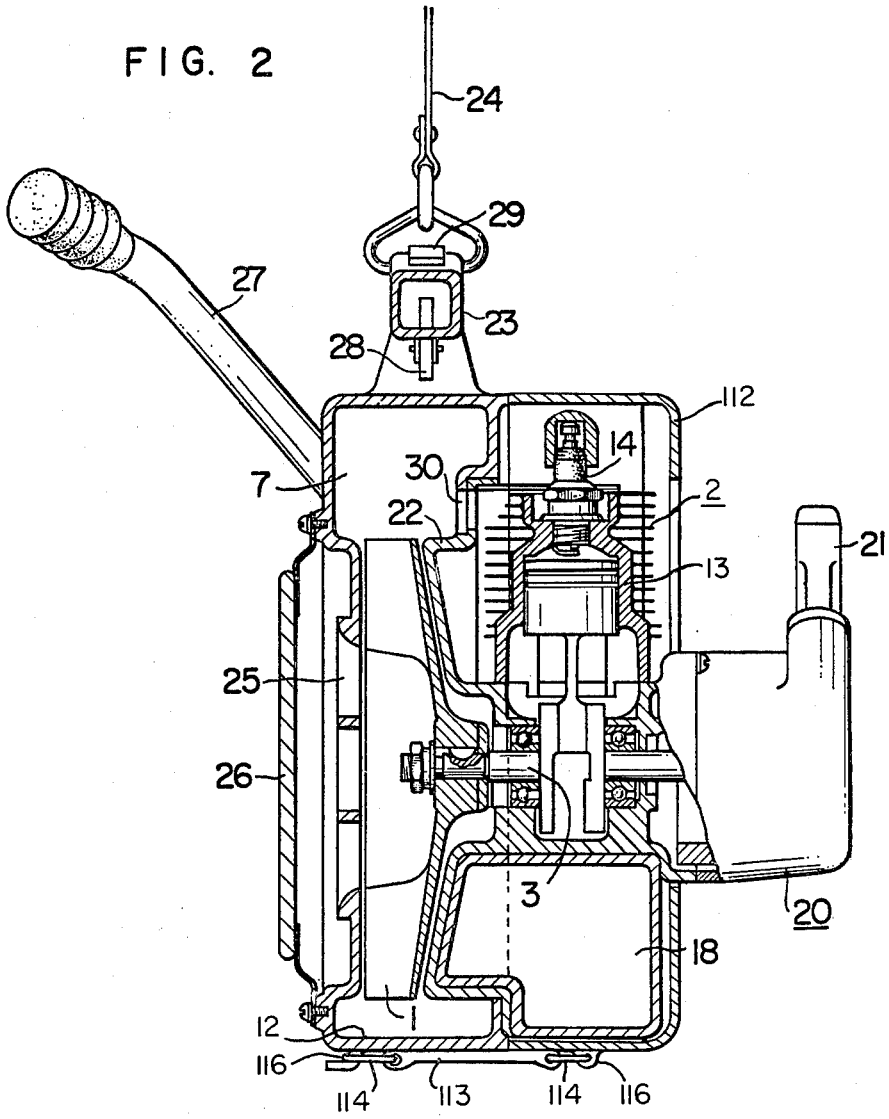
FIG. 2 is a sectional rear end view of the apparatus shown in FIG. 1.

The air ejecting pipe 11 has attached to a portion thereof near the flexible pipe 9 an operating handle 27 which extends, as can be seen in FIGS. 1 and 2, upwardly leftwardly in FIG. 2 and upwardly toward the frame or upwardly toward the left side of FIG. 1. The operating handle 27 not only facilitates the operation of the air ejecting pipe 11 in the forward direction but also has particular utility in cleaning an upper part or removing dust from the ceiling of a room.

The grip 23 has mounted therein a throttle valve trigger 28 and an engine stop switch 29. The numeral 30 designates an opening through which an air current for cooling the cylinder 13 is introduced from the volute casing 7.

The operation of the pneumatic sweeping apparatus of the type carried by means of a strap worn over the shoulder of the operator will be described in comparison with the operation of a pneumatic sweeping apparatus of the type carried on the back of the operator.

In the case of a pneumatic sweeping apparatus of the type carried on the back of the operator, the engine is first started by pulling the rope grip of the starter and then the apparatus is placed on the back with the air ejecting pipe extending forwardly on one side of the operator's body. The operator grips the air ejecting pipe directly with one hand and grips, with the other hand, the throttle valve operating lever so as to start the operation of the pneumatic sweeping apparatus to perform a sweeping operation by means of an air current discharged through the air ejecting pipe. In this type of pnuematic sweeping apparatus, limits are placed on the range in which the air ejecting pipe 11 can be moved, by the fact that the apparatus is carried on the back of the operator. Thus the zone in which pneumatic sweeping can be carried out is small and difficulties are increasingly experienced in operating the air ejecting pipe. For example, the pneumatic sweeping apparatus of the prior art which is carried on the back has little utility in performing a sweeping operation in narrow places, the ceiling, spaces under the seats of a baseball stadium or the like, or gardens where trees and bushes are growing here and there, for example. Also, should the apparatus be stained by leaked fuel or a fire start in the apparatus due to engine trouble, there would be a very large likelihood of the operator being unable to remove the burning apparatus from his body soon enough to escape from the danger of being exposed to the fire.

As compared with the pneumatic sweeping apparatus described above, the pneumatic sweeping apparatus adapted to be carried by means of a shoulder strap according to the invention offers many advantages. The apparatus can be operated by holding fast the grip 23 with one hand and the frame of the apparatus can be held in any position as desired depending on the site and condition of operation, in addition to the apparatus being carried by a strap worn over the shoulder. The air ejecting pipe 11 can be operated as desired by manipulating the operating handle 27 with the other hand. Also, even if a fire should break out in the engine, there is no possibility of the life of the operator being exposed to danger.

It will be obvious to those skilled in the art that various changes may be made without departing from the scope of the invention and the invention is not to be considered limited to what is shown in the drawings and described in the specification.

What is claimed is:

1. A shoulder-supported pneumatic sweeping apparatus comprising:

a frame;

a light weight engine mounted in said frame;

a fan mounted on an output shaft of said engine in said frame;

an outlet port formed in said frame for an air current produced by the rotation of said fan;

a grip having a throttle valve trigger and an engine stop switch located on an upper portion of said frame;

means isolating said grip from vibration imparted to said frame by operation of said engine;

means detachably securing said grip and said isolating means in said frame;

a shoulder strap connected to opposite ends of the upper portion of said grip;

an air ejecting pipe connected to said outlet port through a flexible pipe; and an operating handle attached to said air ejecting pipe, said operating handle extending upwardly sidewards, whereby said frame can be supported by the shoulder of the operator by means of said shoulder strap and a pneumatic sweeping operation can be performed while the operator holds the grip in one hand and the operating handle in the other hand.

2. A shoulder-supported pneumatic sweeping apparatus as claimed in claim 1, wherein said fan is a centrifugal fan.

3. A shoulder-supported pneumatic sweeping apparatus as defined in claims 1 or 2 comprising a cover detachably secured to said frame, said frame and said cover each having a hook provided thereon, and a strap with fastener members detachably engaged with said hooks whereby said cover is detachably secured to said frame.

* * * * *